US011146027B2

(12) United States Patent
Wang et al.

(10) Patent No.: US 11,146,027 B2
(45) Date of Patent: Oct. 12, 2021

(54) ELECTRICAL RECEPTACLE CONNECTOR

(71) Applicant: Advanced Connectek Inc., New Taipei (TW)

(72) Inventors: Shu-Fen Wang, New Taipei (TW); Hung-Ming Chuang, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 0 days.

(21) Appl. No.: 16/801,109

(22) Filed: Feb. 25, 2020

(65) Prior Publication Data

US 2020/0274302 A1 Aug. 27, 2020

(30) Foreign Application Priority Data

Feb. 27, 2019 (TW) ..... 108202541

(51) Int. Cl.
*H01R 13/6591* (2011.01)
*H01R 13/6585* (2011.01)
*H01R 13/6594* (2011.01)

(52) U.S. Cl.
CPC ..... *H01R 13/6591* (2013.01); *H01R 13/6585* (2013.01); *H01R 13/6594* (2013.01)

(58) Field of Classification Search
None
See application file for complete search history.

(56) References Cited

U.S. PATENT DOCUMENTS

| | | | | |
|---|---|---|---|---|
| 2017/0133795 | A1* | 5/2017 | Guo | H01R 13/6581 |
| 2017/0194745 | A1* | 7/2017 | Tsai | H01R 13/6582 |
| 2017/0222373 | A1* | 8/2017 | Tsai | H01R 13/6585 |
| 2017/0264034 | A1* | 9/2017 | Du | H01R 13/6594 |
| 2017/0271822 | A1* | 9/2017 | Zhang | H01R 13/6585 |
| 2017/0346236 | A1* | 11/2017 | Long | H01R 13/659 |
| 2018/0183188 | A1* | 6/2018 | Tsai | H01R 13/6585 |
| 2019/0221953 | A1* | 7/2019 | Chen | H01R 13/6594 |
| 2020/0274298 | A1* | 8/2020 | Hashimoto | H01R 24/50 |
| 2020/0274302 | A1* | 8/2020 | Wang | H01R 13/6585 |

* cited by examiner

*Primary Examiner* — James Harvey
(74) *Attorney, Agent, or Firm* — JCIPRNET

(57) ABSTRACT

An electrical receptacle connector configured to be disposed on an electronic device is provided. The electrical receptacle connector includes an insulation body, a first terminal set, a second terminal set, and a shell. The first terminal set and the second terminal set are combined to the insulation body in an up-and-down manner. The shell has a body and at least one protrusion. The body covers the first terminal set, the second terminal set, and the insulation body, and the at least one protrusion extends from the body and away from the insulation body, the first terminal set, and the second terminal set and abuts against the electronic device.

20 Claims, 5 Drawing Sheets

ELECTRICAL RECEPTACLE CONNECTOR

CROSS-REFERENCE TO RELATED APPLICATION

This application claims the priority benefit of Taiwan patent application serial no. 108202541, filed on Feb. 27, 2019. The entirety of the above-mentioned patent application is hereby incorporated by reference herein and made a part of this specification.

BACKGROUND

Technical Field

This disclosure relates to an electrical receptacle connector.

Description of Related Art

With the development of electronic technology, connectors are widely used in electronic devices, and signals of electronic devices can may transmitted by two connectors electrically connected to each other.

However, since the development trend of the existing electronic device is toward light weight and compactness, the space required for assembling the connector is often limited by the internal space of the electronic device, and the assembling process bothers relevant personnel because said process should be performed within the limited space.

In addition, the space where the terminals are connected is also limited, and thus the design layout of the connector terminals may not be achieved as defined, which reduces design flexibility.

Moreover, the interval of adjacent connectors is also shortened due to the limited space, thus easily leading to electromagnetic interference and crosstalk interference between the connectors.

SUMMARY

The disclosure provides an electrical receptacle connector configured to be disposed on an electronic device. The electrical receptacle connector abuts against the electronic device through at least one protrusion extending from a shell.

An electrical receptacle connector provided in an embodiment of the disclosure is configured to be disposed on electronic device. The electrical receptacle connector includes an insulation body, a first terminal set, a second terminal set, and a shell. The first terminal set and the second terminal set are combined to the insulation body in an up-and-down manner. The shell has a body and at least one protrusion, the body covers the first terminal set, the second terminal set, and the insulation body, and the at least one protrusion extends from the body and away from the insulation body, the first terminal set, and the second terminal set and abuts against the electronic device.

In an embodiment of the disclosure, the shell is electrically conductive, and the at least one protrusion is electrically connected to at least one conductive portion of the electronic device, so that the shell and the at least one conductive portion provide electromagnetic shielding, electrical grounding, or both.

In an embodiment of the disclosure, the at least one conductive portion is a casing of the electronic device.

In an embodiment of the disclosure, the at least one protrusion is an elastic sheet structure bent outward away from the insulation body, the first terminal set, and the second terminal set from the shell.

In an embodiment of the disclosure, the electronic device includes a circuit board, and the at least one conductive portion is a ground circuit of the circuit board.

In an embodiment of the disclosure, the at least one protrusion is a pin extending from the shell.

In an embodiment of the disclosure, the body includes an outer shell and an inner shell, the inner shell surrounds the insulation body, the first terminal set, and the second terminal set, and the outer shell is stacked onto the inner shell.

In an embodiment of the disclosure, the at least one protrusion is an elastic sheet structure extending from the outer shell in an outward manner away from the inner shell.

In an embodiment of the disclosure, the at least one protrusion is a pin extending from the outer shell in an outward manner away from the inner shell.

In an embodiment of the disclosure, the at least one protrusion is a bend extending from the inner shell in an outward manner away from the insulation body, the first terminal set, and the second terminal set.

In an embodiment of the disclosure, the outer shell has a plurality of protrusions. Parts of the protrusions are elastic sheet structures extending from the outer shell in an outward manner away from the inner shell, and the other parts of the protrusions are pins extending from the outer shell in an outward manner away from the inner shell.

In an embodiment of the disclosure, the electronic device includes a circuit board, the pin has a necking and is inserted into an opening of the circuit board, and the shell is soldered to the circuit board through filling the necking and the opening with a solder material.

In an embodiment of the disclosure, the at least one conductive portion is a ground circuit of the circuit board, and the pin is electrically connected to the ground circuit.

In view of the foregoing, the electrical receptacle connector provided on one or more embodiments of the disclosure includes the body and at least one protrusion extending from the body, and the at least one protrusion extends away from the insulation body, the first terminal set, and the second terminal set and abuts against then electronic device. Through the protrusion of the shell, the electrical receptacle connector is able to contact the electronic device, so as to position, limit, or fix the structure through the structural contact, and electrical relationship or the like may also be improved.

Several exemplary embodiments accompanied with figures are described in detail below to further describe the disclosure in details.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles described herein.

DESCRIPTION OF THE EMBODIMENTS

Figure 1:
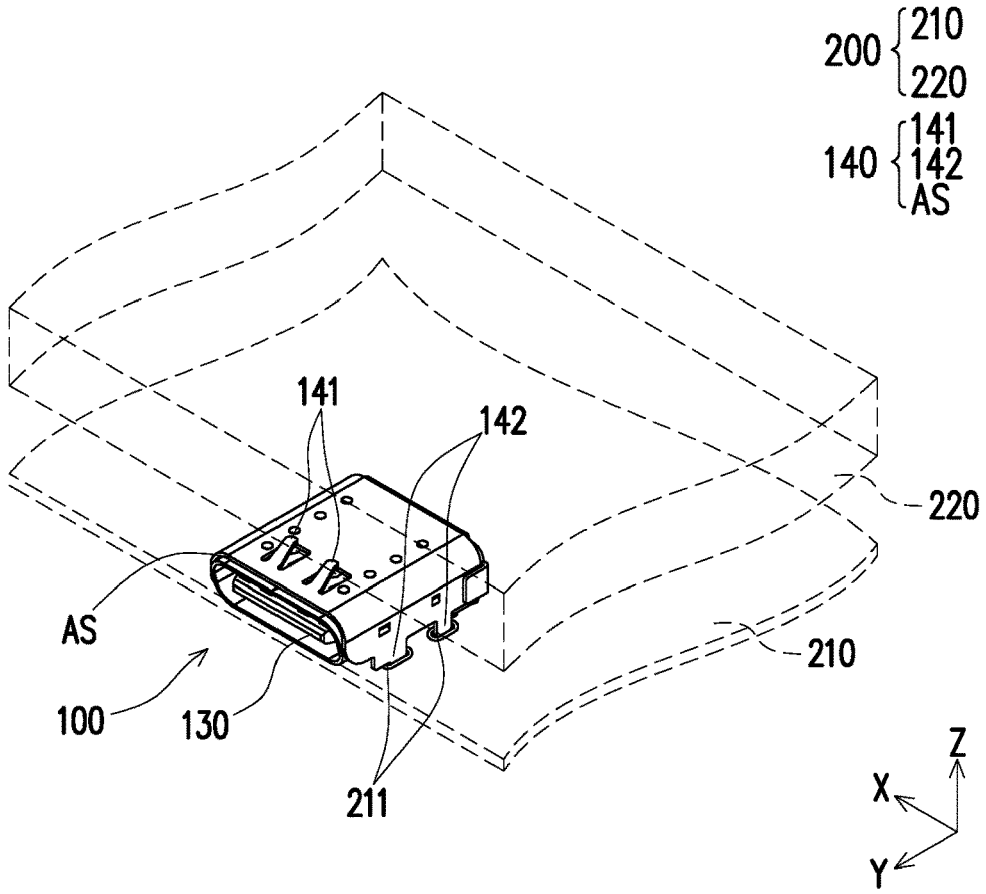
FIG. 1 is a schematic diagram of an electrical receptacle connector according to an embodiment of the disclosure.
Figure 2:
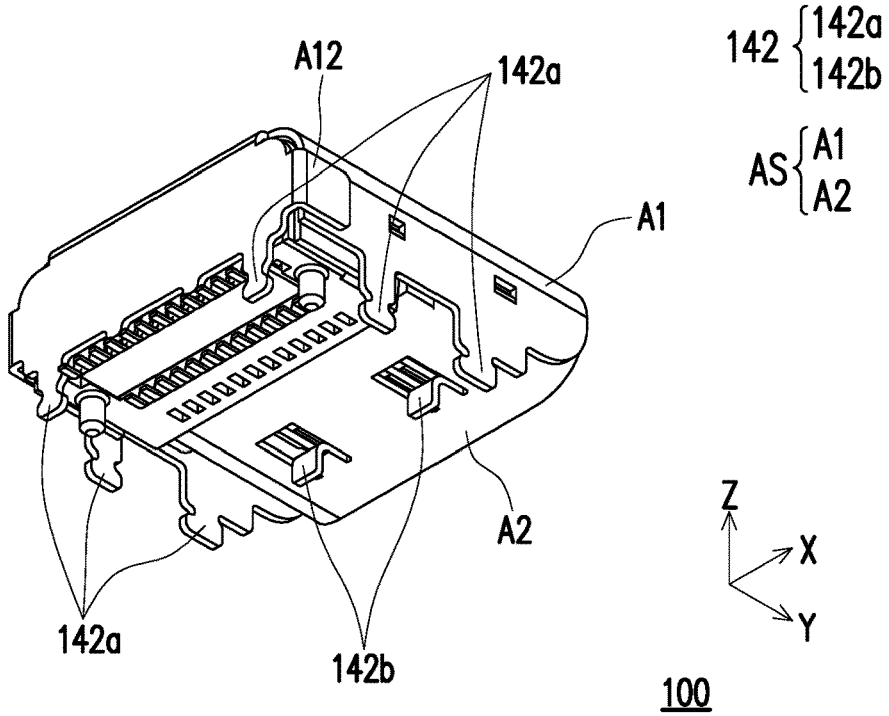
FIG. 2 illustrates the electrical receptacle connector in FIG. 1 from another perspective.

FIG. 1 is a schematic diagram of an electrical receptacle connector according to an embodiment of the disclosure. FIG. 2 illustrates the electrical receptacle connector in FIG. 1 from another perspective. Note that FIG. 1 further schematically illustrates the correspondence relationship between the electrical receptacle connector and the electronic device to which the electrical receptacle connector is applied, and rectangular coordinates X-Y-Z are also provided in the embodiment for better description of the components. With reference to FIG. 1 and FIG. 2, in this embodiment, an electrical receptacle connector 100 is configured to be disposed on a circuit board 210 of an electronic device 200, so that other electronic devices may also be electrically connected to the electrical receptacle connector 100 through corresponding connectors, which allows electrical conduction and information transmission between the electronic device 200 and other devices. The electrical receptacle connector 100 includes a first terminal set 110, a second terminal set 120, an insulation body 130, and a shell 140. Here, the first terminal set 110 and the second terminal set 120 are combined to the insulation body 130 in an up-and-down manner in the z-axis, and the combination with the insulation body 130 is performed in particular by embedded injection. In other words, contact portions of the first terminal set 110 are disposed on an upper surface of a tongue portion of the insulation body 130 and contact portions of the second terminal set 120 are disposed on a lower surface of a tongue portion of the insulation body 130.

Figure 3:
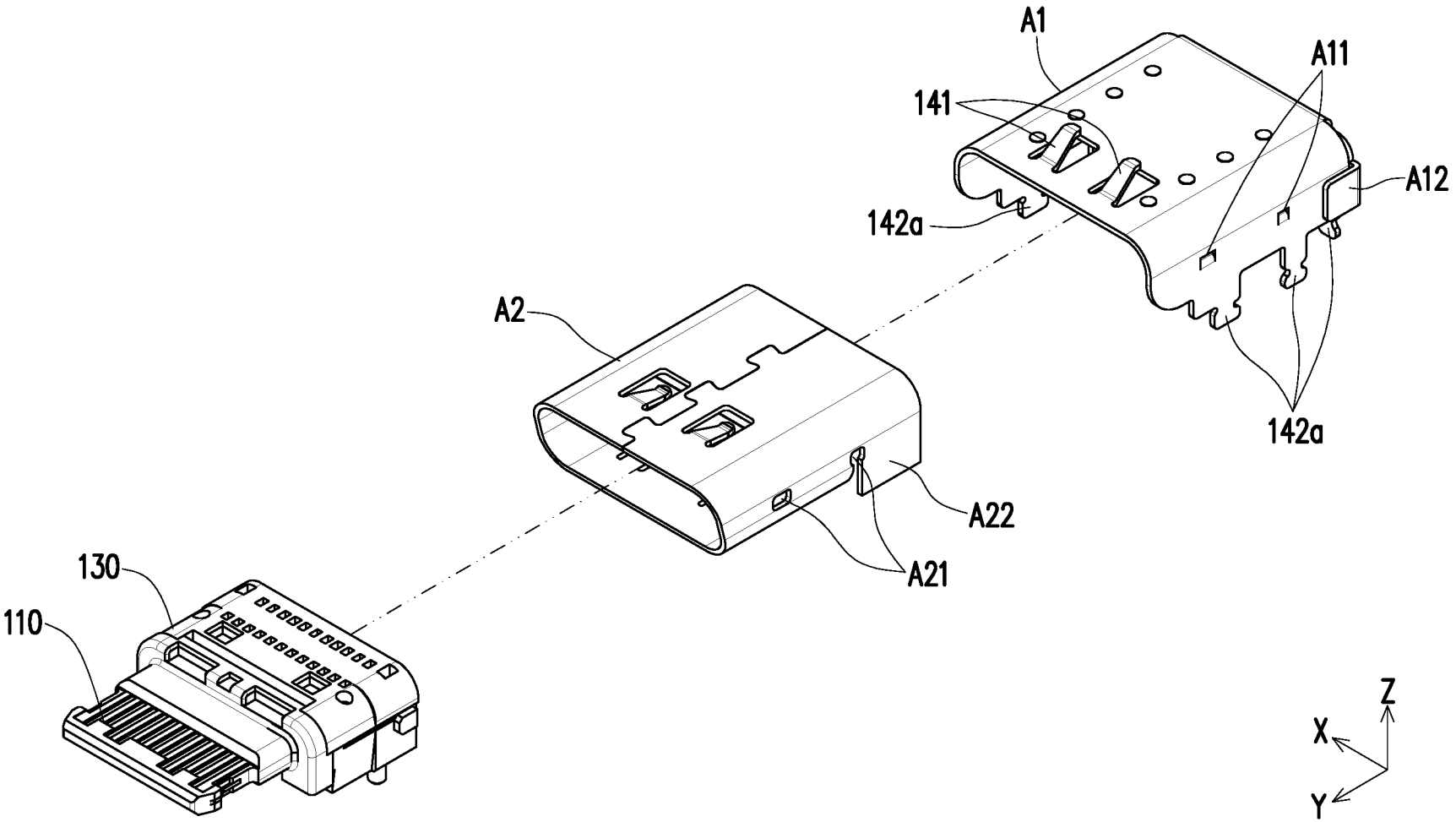
FIG. 3 and FIG. 4 are preliminary exploded views of an electrical receptacle connector from different perspectives.
Figure 4:
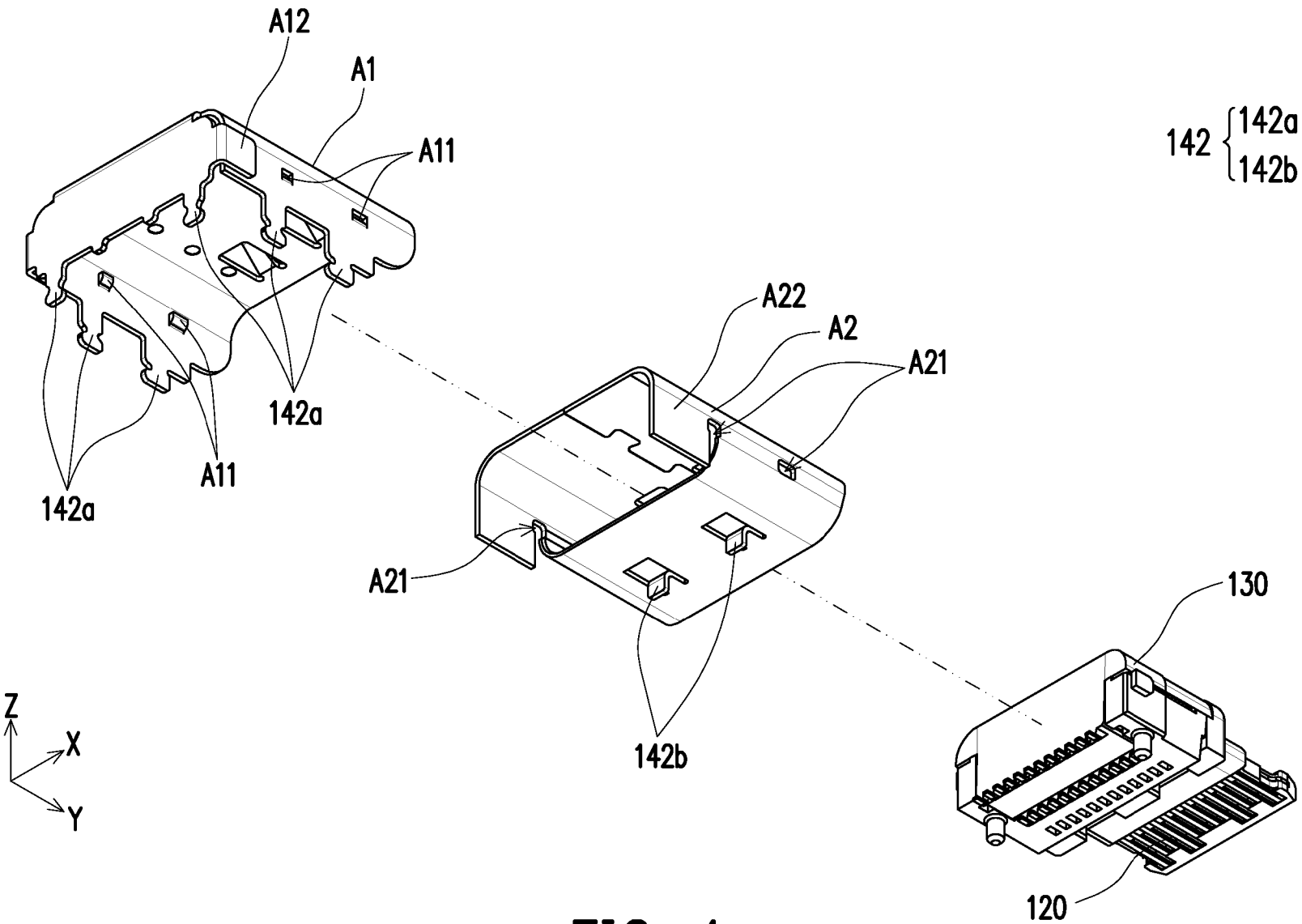

Note that the shell 140 in this embodiment is metallic and electrically conductive and is divided into a body AS and at least one protrusion. Here, the protrusion structure abuts against (contacts) the electronic device 200, so as to achieve the desired positioning, limiting, and other fixing effects as well as accomplish the electrical connection to a conductive portion of the electronic device 200, whereby the shell 140 and the conductive portion provide electromagnetic shielding, potential grounding, or both. Further, FIG. 3 and FIG. 4 are preliminary exploded views of an electrical receptacle connector from different perspectives. The body AS of the shell 140 includes an outer shell A1 and an inner shell A2 stacked together. The outer shell A1 partially surrounds and covers the four sides of the inner shell A2. The first terminal set 110, the second terminal set 120, and the insulation body 130 are combined and then placed in the inner shell A2, so that the inner shell A2 surrounds the first terminal set 110, the second terminal set 120, and the insulation body 130. The inner shell A2 and the outer shell A1 are then assembled to each other, and the outer shell A1 is assembled to the circuit board 210 to complete component configuration.

As shown in FIG. 1, in this embodiment, the conductive portion includes a ground circuit (a ground pad) 211 of the circuit board 210 and a casing 220 of the electronic device 200, wherein the casing 220 is electrically conductive. Protrusions 141 and 142 extend from the body AS and away from the insulation body 130, the first terminal set 110, and the second terminal set 120. Here, the protrusions 141 are located on a top surface of the body AS and extend toward the positive x-axis direction with respect to the top surface. Therefore, the protrusions 141 may be considered as elastic sheet structures bent from the shell 140 in an outward manner, so as to abut against the casing 220 and achieve the desired structural positioning and limiting effects. The protrusions 142 are pins or bends extending from the body AS in the negative z-axis direction and is configured to be inserted into a socket of the circuit board 210. Here, the pins are also soldered to the ground pad (the ground circuit 211) of the circuit board 210, and the shell 140 is fixed to the circuit board 210 at the same time.

As such, in addition to the positioning, limiting, or fixing effects achieved through the structural abutment, the shell 140 of the electrical receptacle connector 100 provided in this embodiment is also electrically conductive because the protrusions 141 and the casing 220 abut against each other; therefore, electromagnetic shielding is provided for the first terminal set 110 and the second terminal set 120 in the shell 140, and possible electrical interference to the electrical receptacle connector 100 by other electronic components (e.g., other electrical connectors) in the electronic device 200 may be blocked.

Furthermore, the shell 140 also provides electrical grounding to the electrical receptacle connector 100 through the electrical connection between the protrusions 142 and the ground circuit 211 of the circuit board 210; at the same time, ground pins of the first terminal set 110 and the second terminal set 120 may be further electrically conducted to the shell 140, so as to collectively ground the first terminal set 110, the second terminal set 120, and the shell 140 to the ground circuit 211. When an electrical plug connector is electrically connected to the electrical receptacle connector 100, the effect of common electrical grounding may also be achieved, so that the ground potentials are consistent.

Note that the electromagnetic shielding provided by the protrusions 141 and the casing 220 or the electrical grounding provided by the protrusions 142 and the ground circuit 211 of the circuit board 210 may be completed independently. In other words, the designer of the electrical receptacle connector 100 may select to apply at least one of the above-mentioned electrical or magnetic relationships according to actual needs.

Figure 5:
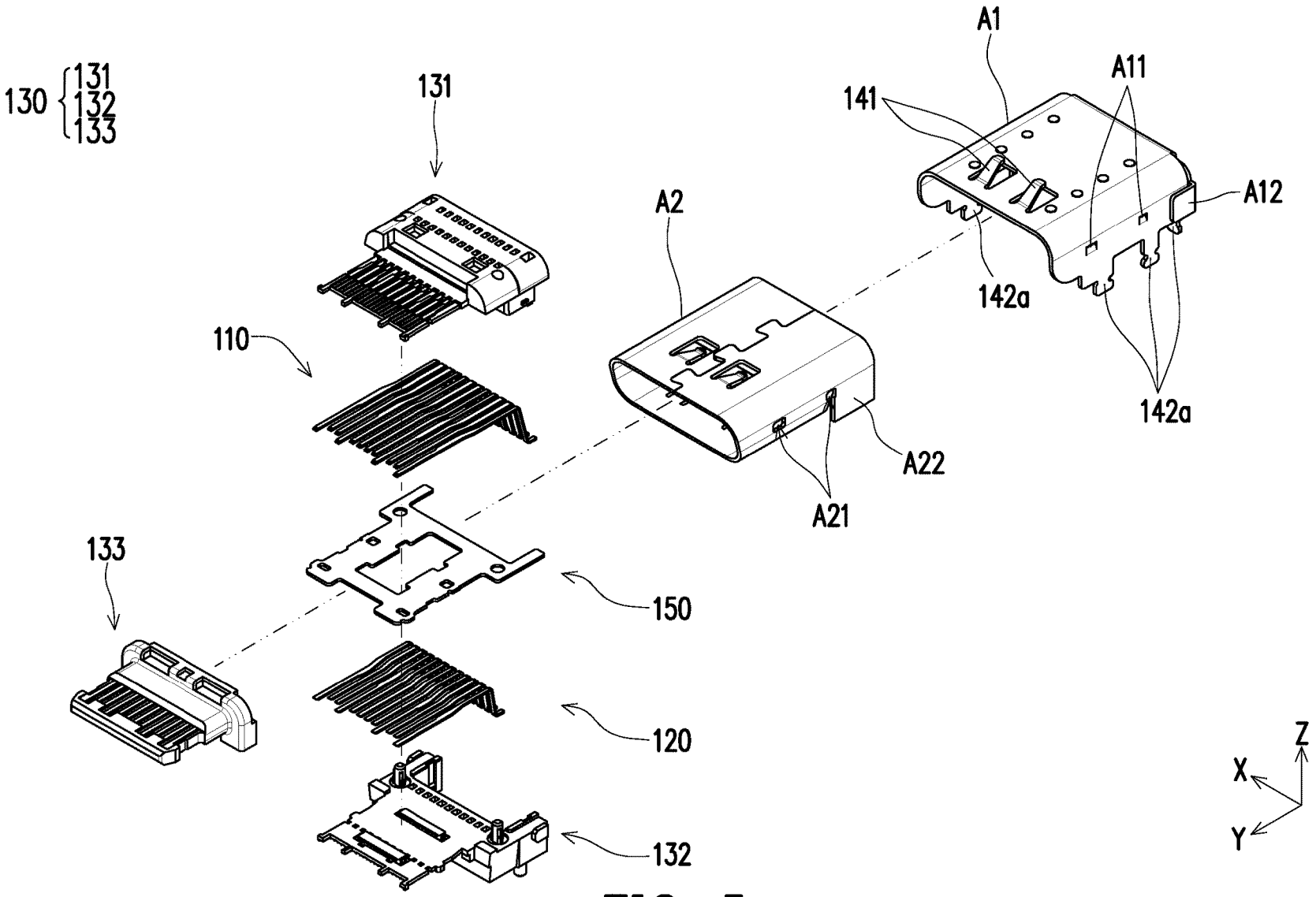
FIG. 5 is an advanced exploded view of an electrical receptacle connector.

FIG. 5 is an advanced exploded view of an electrical receptacle connector. With reference to FIG. 5, in this embodiment, the electrical receptacle connector 100 also includes a mid-plate 150 which is sandwiched between the first terminal set 110 and the second terminal set 120. The mid-plate 150 can be assembled or molded inside a main component 133 of the insulation body 130 and between a first terminal module including the first terminal set 110 and an upper component 131 of the insulation body 130 and a second terminal module including the second terminal set 120 and a lower component 132 of the insulation body 130.

Here, the mid-plate 150 not only provides electromagnetic shielding between the first terminal set 110 and the second terminal set 120 but also electrically connects the shell 140, so that the mid-plate 150, the shell 140, and the casing 220 of the electronic device 200 commonly provide electromagnetic shielding and electrical grounding.

As shown in FIG. 2 to FIG. 4, in this embodiment, the body AS includes the outer shell A1 and the inner shell A2, and thus the protrusions 141 are substantially elastic sheet structures extending from the outer shell A1 in an outward manner away from the inner shell A2. Thereby, when the electrical receptacle connector 100 is assembled into the electronic device 200 together with the circuit board 210, the elasticity (deformable margin) of the elastic sheet structure ensures the electrical receptacle connector 100 and the casing 220 to abut against each other.

Besides, unlike the protrusions 141, the protrusions 142 provided in this embodiment are further divided into protrusions 142*a* and protrusions 142*b* at different locations. The protrusions 142*a* are disposed on the outer shell A1 and along the peripheries of the structure. The protrusions 142*b* are disposed on the inner shell A2 and substantially located at a lower surface of the ring-shaped structure. By contrast, although the entire conductive portion (the ground circuit 211) is not shown due to the illustration perspective, it can be easily known that the ground circuit 211 on the circuit board 210 is arranged corresponding to the protrusions 142*a* and 142*b*. Further, in this embodiment, the protrusions 142*b* are bends extending from the inner shell A2 in an outward manner (toward the negative z-axis direction in the drawings) away from the insulation body 130, the first terminal set 110, and the second terminal set 120, and the protrusions 142*a* are pins extending from the outer shell A1 in an outward manner (in the negative z-axis direction) away from the inner shell A2. In either situation, the protrusion inserted into the circuit board 210 is able to provide the desired structural positioning and fixing effects.

As shown in FIG. 3 to FIG. 5, in this embodiment, the outer shell A1 further has buckling portions A11 on both sides, and the buckling portions A11 are, for instance, elastic sheets formed after structural breach; the inner shell A2 also has buckling portions A21 on both sides, and the buckling portions A21 are a closed buttonhole and an open buttonhole. Through the buckling actions of the buckling portions A11 and the buckling portion A21, the outer shell A1 is well assembled to the inner shell A2 and stacked onto the inner shell A2. Furthermore, the outer shell A1 further has clamping portions A12 on both sides, and the inner shell A2 also has clamping portions A22 on both sides. When the outer shell A1 and the inner shell A2 are assembled to each other, the clamping actions of the clamping portions A12 and the clamping portions A22 allow the outer shell A and the inner shell A2 to be secured to each other.

Although the body AS is divided into the outer shell A1 and the inner shell A2 that may be assembled to each other, in another embodiment not shown in the drawings, the outer shell A1 and the inner shell A2 of the body AS may also be integrally formed, so as to simplify the manufacturing process and reduce the costs.

Figure 6:
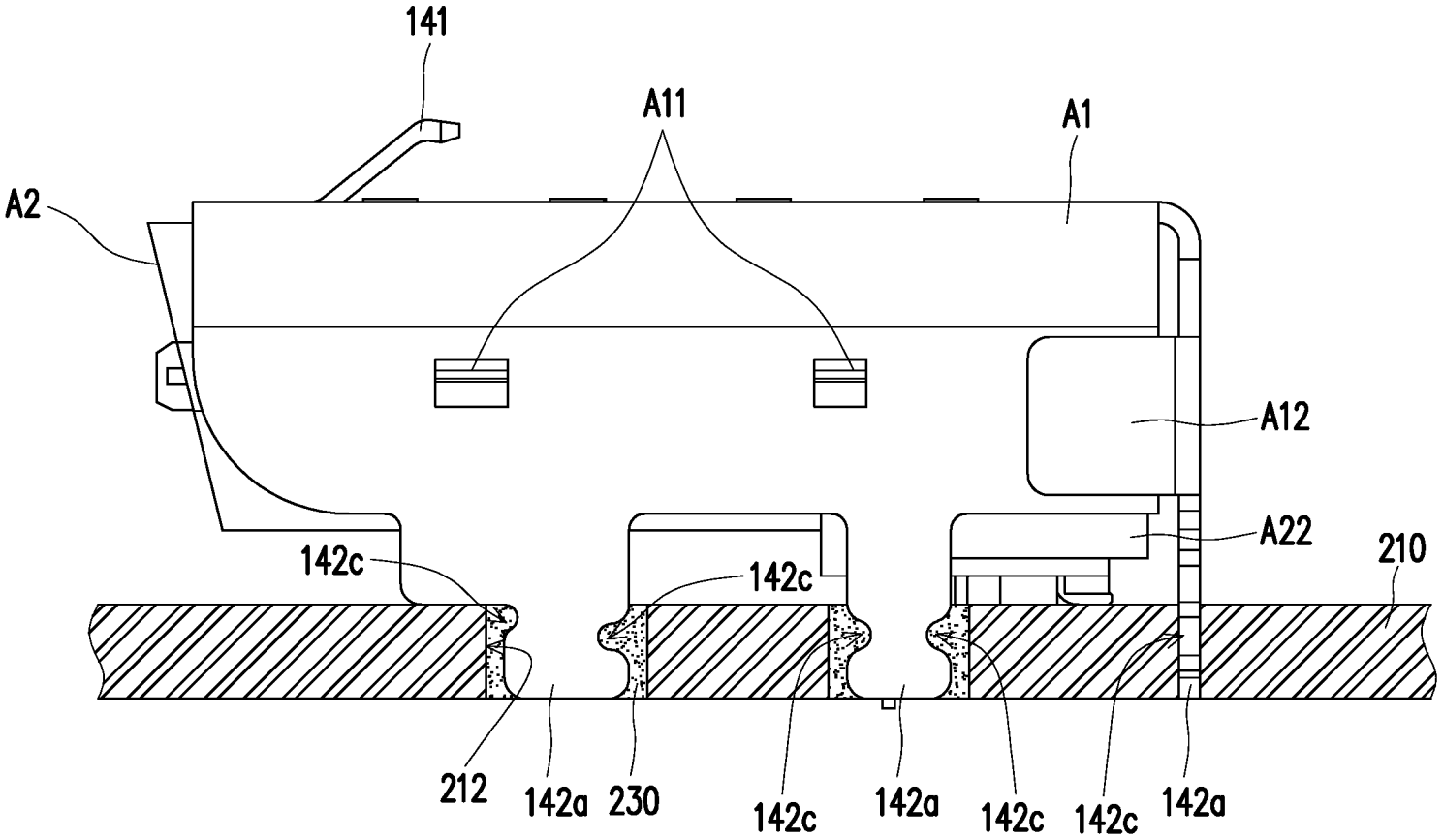
FIG. 6 is a partial cross-sectional view of the electrical receptacle connector and the circuit board in FIG. 1.

FIG. 6 is a partial cross-sectional view of the electrical receptacle connector and the circuit board in FIG. 1. With reference to FIG. 1 and FIG. 6 at the same time, as described above, the protrusions 142*a* may be considered as the connection structure between the shell 140 and the circuit board 210. As shown in FIG. 6, the circuit board 210 has an opening 212 into which the protrusions 142*a* (pins) may be inserted. Furthermore, the protrusions 142*a* (the pins) also have neckings 142*c*; therefore, in the process of soldering the shell 140 to the circuit board 210, the protrusions 142*a* (the pins) are inserted into the opening 212, and the neckings 142*c* and the opening 212 are filled with a solder material 230 to fix the shell 140 to the circuit board 210. As such, the shell 140 and the ground circuit 211 of the circuit board 210 (shown in FIG. 1) may also be electrically conducted to each other through the solder material 230.

To sum up, in one or more embodiments of the disclosure, the electrical receptacle connector includes the body and at least one protrusion extending from the body, and the at least one protrusion extends away from the insulation body, the first terminal set, and the second terminal set and is then electrically conducted to at least one conductive portion of the electronic device. Further, the conductive portion of the electronic device includes the electrically conductive casing and the ground circuit of the circuit board, while the protrusions of the shell include the protrusions extending from the body and abutting against the protrusions of the casing and the protrusions extending from the body and inserted into the circuit board to be electrically connected to the ground circuit.

Since the protrusions abut against and are electrically connected to the casing, and the protrusions are electrically connected to the ground circuit of the circuit board, the electrical receptacle connector is commonly electrically grounded together with the electronic device; besides, the electronic device may provide electromagnetic shielding on the first terminal set and the second terminal set of the electrical receptacle connector, so as to effectively prevent electromagnetic interference, crosstalk interference, or the like.

It will be apparent to those skilled in the art that various modifications and variations can be made to the disclosed embodiment without departing from the scope or spirit of the disclosure. In view of the foregoing, it is intended that the disclosure covers modifications and variations provided that they fall within the scope of the following claims and their equivalents.

What is claimed is:

1. An electrical receptacle connector configured to be disposed on an electronic device and comprising:

an insulation body;

a first terminal set and a second terminal set combined to the insulation body, wherein contact portions of the first terminal set are disposed on an upper surface of a tongue portion of the insulation body and contact portions of the second terminal set are disposed on a lower surface of a tongue portion of the insulation body; and a shell having a body and at least one protrusion, the body covering the first terminal set, the second terminal set, and the insulation body, the at least one protrusion extending from the body and away from the insulation body, the first terminal set, and the second terminal set and abutting against the electronic device, wherein the at least one protrusion has a necking comprising wide parts and a narrow part between the wide parts along an extending axis of the protrusion, and the narrow part is filled with a solder material.

2. The electrical receptacle connector according to claim 1, wherein the shell is electrically conductive, and the at least one protrusion is electrically connected to at least one conductive portion of the electronic device, so that the shell and the at least one conductive portion provide electromagnetic shielding, electrical grounding, or both.

3. The electrical receptacle connector according to claim 2, wherein the at least one conductive portion is a casing of the electronic device.

4. The electrical receptacle connector according to claim 2, wherein the electronic device comprises a circuit board, and the at least one conductive portion is a ground circuit of the circuit board.

5. The electrical receptacle connector according to claim 1, wherein the at least one protrusion is an elastic sheet structure bent outward away from the insulation body, the first terminal set, and the second terminal set from the shell.

6. The electrical receptacle connector according to claim 1, wherein the at least one protrusion is a pin extending from the shell.

7. The electrical receptacle connector according to claim 1, wherein the body comprises an outer shell and an inner shell, the inner shell surrounds the insulation body, the first terminal set, and the second terminal set, and the outer shell is stacked onto the inner shell.

8. The electrical receptacle connector according to claim 7, wherein the at least one protrusion is an elastic sheet structure extending from the outer shell in an outward manner away from the inner shell.

9. The electrical receptacle connector according to claim 7, wherein the at least one protrusion is a pin extending from the outer shell in an outward manner away from the inner shell.

10. The electrical receptacle connector according to claim 7, wherein the at least one protrusion is disposed on the inner shell and located at a lower surface of the inner shell, and the at least one protrusion is a bend extending from the inner shell in an outward manner away from the insulation body, the first terminal set, and the second terminal set, wherein the inner shell and the outer shell further comprises clamping portions on both sides respectively, and the outer shell and the inner shell are secured to each other via the clamping actions of the clamping portions correspondingly.

11. The electrical receptacle connector according to claim 7, wherein the outer shell has a plurality of protrusions, parts of the protrusions are elastic sheet structures extending from the outer shell in an outward manner away from the inner shell, and the other parts of the protrusions are pins extending from the outer shell in an outward manner away from the inner shell.

12. The electrical receptacle connector according to claim 6, wherein the electronic device comprises a circuit board, the pin has the necking and is inserted into an opening of the circuit board, and the shell is soldered to the circuit board through filling the necking and the opening with the solder material.

13. The electrical receptacle connector according to claim 12, wherein the at least one conductive portion is a ground circuit of the circuit board, and the pin is electrically connected to the ground circuit.

14. The electrical receptacle connector according to claim 1, wherein the shell is a metallic shell.

15. The electrical receptacle connector according to claim 1, further comprising a mid-plate which is sandwiched between the first terminal set and the second terminal set.

16. The electrical receptacle connector according to claim 1, wherein the first terminal set disposed on the upper surface of the tongue portion of the insulation body and the second terminal set disposed on the lower surface of the tongue portion of the insulation body are in an up-and-down manner.

17. An electrical receptacle connector configured to be disposed on an electronic device and comprising:

an insulation body;

a first terminal set and a second terminal set combined to the insulation body, wherein contact portions of the first terminal set are disposed on an upper surface of a tongue portion of the insulation body and contact portions of the second terminal set are disposed on a lower surface of a tongue portion of the insulation body;

a mid-plate sandwiched between the first terminal set and the second terminal set;

an inner shell surrounding the insulation body, the first terminal set, and the second terminal set; and an outer shell stacking onto the inner shell, wherein the outer shell comprises at least one protrusion extending from the outer shell and away from the insulation body, the first terminal set, and the second terminal set and abutting against the electronic device, wherein the at least one protrusion has a necking comprising wide parts and a narrow part between the wide parts along an extending axis of the protrusion, and the narrow part is filled with a solder material.

18. The electrical receptacle connector according to claim 17, wherein the inner shell and the outer shell are electrically conductive, and the at least one protrusion is electrically connected to at least one conductive portion of the electronic device, so that the outer shell, the inner shell and the at least one conductive portion provide electromagnetic shielding, electrical grounding, or both.

19. The electrical receptacle connector according to claim 18, wherein the at least one conductive portion is a casing of the electronic device.

20. The electrical receptacle connector according to claim 18, wherein the electronic device comprises a circuit board, and the at least one conductive portion is a ground circuit of the circuit board.

* * * * *